US006658811B2

(12) United States Patent
Bitschnau

(10) Patent No.: US 6,658,811 B2
(45) Date of Patent: Dec. 9, 2003

(54) METHOD OF ERECTING A BUILDING CEILING

(76) Inventor: Lothar Bitschnau, Luttweg 54, A-6780 Bartholomäberg (AT)

( * ) Notice: Subject to any disclaimer, the term of this patent is extended or adjusted under 35 U.S.C. 154(b) by 48 days.

(21) Appl. No.: 10/132,752

(22) Filed: Apr. 25, 2002

(65) Prior Publication Data

US 2002/0157345 A1 Oct. 31, 2002

(30) Foreign Application Priority Data

Apr. 25, 2001 (AT) ..... A 663/2001

(51) Int. Cl.[7] ..... E04B 1/00

(52) U.S. Cl. ..... 52/741.1; 52/745.06; 52/745.01; 52/2.11

(58) Field of Search ..... 2/1, 2.11, 2.17, 2/2.19, 741.1, 745.05, 745.06, 745.01, 747.1, 745.19, 745.2

(56) References Cited

U.S. PATENT DOCUMENTS

| | | | | |
|---|---|---|---|---|
| 3,638,368 A | * | 2/1972 | Pierson | 52/2 |
| 4,107,899 A | * | 8/1978 | Crooks | 52/747 |
| 4,993,630 A | * | 2/1991 | Reichel et al. | 237/49 |

FOREIGN PATENT DOCUMENTS

| | | |
|---|---|---|
| DE | 2224267 | 12/1972 |
| DE | 19923078 | 12/1999 |
| EP | 1087069 | 9/2000 |
| FR | 2215519 | 8/1974 |
| FR | 2367157 | 5/1978 |
| GB | 1488474 | 10/1977 |

* cited by examiner

*Primary Examiner*—Jeanette Chapman
(74) *Attorney, Agent, or Firm*—Friedrich Kueffner

(57) ABSTRACT

A method of erecting a building ceiling in a structure having a floor plate and a circumferentially closed building wall erected on the floor plate, wherein a ceiling plate is manufactured on the floor plate, and wherein the circumferential contour of the ceiling plate corresponds to the inner contour of the building wall. Together with a circumferentially closed and water-tight side wall, the ceiling plate forms a floating body. Water is filled into the space defined by the inner side of the housing wall and the side wall, so that the floating body floats upwardly. When the ceiling height has been reached, the ceiling plate is connected to the building wall. For limiting the upward floatation of the ceiling plate, an inwardly protruding, circumferential stop is mounted on the building wall, wherein the ceiling plate, or a circumferential part tightly connected to the ceiling plate, is pressed in the upper end position of floatation against the stop and the ceiling plate or the circumferential part is sealed relative to the stop.

20 Claims, 5 Drawing Sheets

Fig. 1
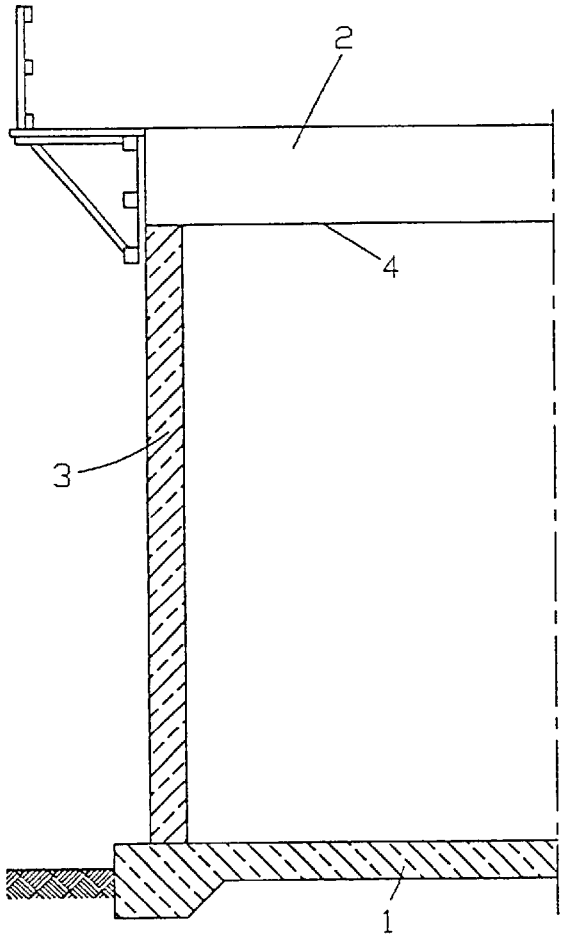
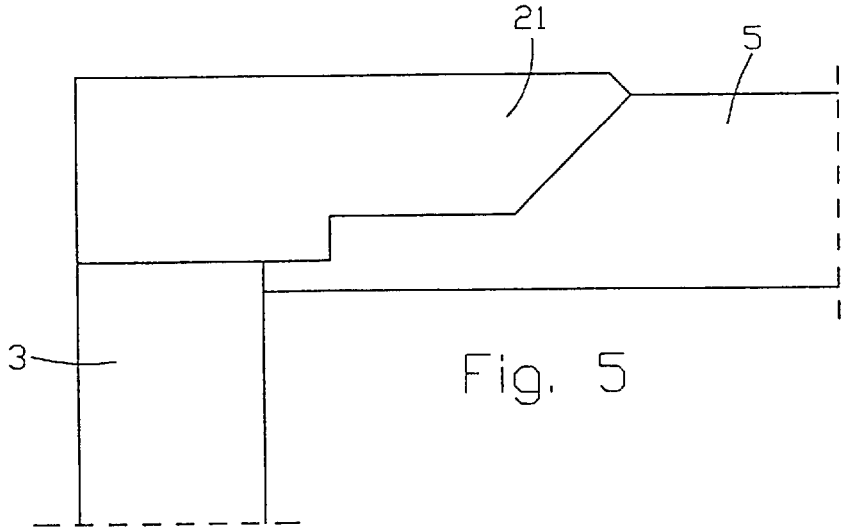
Fig. 5

10
12
10

9
11
8
5
24
23
17
22
3

METHOD OF ERECTING A BUILDING CEILING

BACKGROUND OF THE INVENTION

1. Field of the Invention

The present invention relates to a method of erecting a building ceiling in a structure with a floor plate and a circumferentially closed building wall erected on the floor plate, wherein a ceiling plate which is manufactured on the floor plate and whose circumferential contour is constructed so as to correspond to the inner contour of the building wall and together with a circumferentially closed and water-tight side wall forms a floating body, is allowed to float upwardly by filling water into the space defined by the inner side of the building wall and, after the ceiling height has been reached, the ceiling plate is connected to the building wall.

2. Description of the Related Art

A method of the above-described type is disclosed in DE 199 23 078 A1. In this known method, after the ceiling plate has reached its upper end position, a pressure medium is pumped into a hose which surrounds the ceiling plate in an inserted section so that this hose widens and makes clamping and sealing contact with the inner side of the building wall. Subsequently, the portion of the water column located above the expanded hose can be pumped off, and, due to the sealing action between the ceiling plate and the building wall, the ceiling plate is supported by the water column located underneath the ceiling plate. The reinforcing steel members which protrude upwardly from the upper edge of the wall are then bent inwardly and are connected to reinforcing steel members which are located in a recessed edge portion of the ceiling plate, and the recessed end portion is then filled with concrete.

This known method has the disadvantage of a relatively complicated and ineffective sealing action between the ceiling plate and the building wall in the upper end position of the ceiling plate produced by the expandable hose. Because of the uneven surface of the concrete, this sealing action is not completely possible so that water can penetrate. Moreover, the insert section which receives the hose is a relatively sensitive component and is subjected to contamination and/or damage resulting from the subsequent filling in of the concrete for the ceiling plates or also of the building wall.

A similar method is disclosed in EP 1 087 069 A2. However, in this case, the ceiling plate does not form part of a floating body; rather, the ceiling plate is sealed relative to the building wall from the outset and is pushed upwardly in the manner of a piston by means of a medium to which pressure is applied, such as water or air. Also in this case, for effecting a sealing action between the ceiling plate, a circumferentially expandable hose is used or a sealing lip which is secured against being bent upwardly.

SUMMARY OF THE INVENTION

Therefore, it is the primary object to provide an improved method of the above-described type.

In accordance with the present invention, an inwardly protruding, circumferential stop is provided at the building wall for limiting the upward flotation of the ceiling plate, wherein, in the upper end position of floatation of the ceiling plate, the ceiling plate or a circumferential part tightly connected to the ceiling plate is pressed against the stop, so that the ceiling plate or the circumferential part is sealed relative to the stop.

The circumferentially extending or circumferentially closed stop produces a very effective sealing action between the ceiling plate and the building wall, wherein the sealing system may be of particularly simple construction. In principle, it would be conceivable and possible to achieve such a sealing action by pressing two flat surfaces against each other. However, preferably a sealing member is arranged at the stop between the stop and the ceiling plate or the circumferential part and/or a sealing member is provided at the ceiling plate or at the circumferential part.

Moreover, in accordance with the method of the present invention, a certain contact pressure of the ceiling plate against the circumferential stop may be applied by providing the water body underneath the ceiling plate with a slight excess pressure. This makes it possible to absorb the subsequently introduced additional load of the connection concrete, without causing a lowering of the building ceiling. In the known methods, it was necessary for this purpose to place anchoring members in the outer edge of the concrete of the building wall and later to mount horizontal rails which protruded inwardly beyond the upper edge of the wall in order to produce the contact pressure; this required additional work steps.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 1 is a vertical sectional view of a silo-like structure to be erected, wherein the floor plate and the building wall have already been finished;

FIG. 5 shows as a detail the connection between the building wall and the ceiling plate;

DETAILED DESCRIPTION OF THE INVENTION

Figure 2:
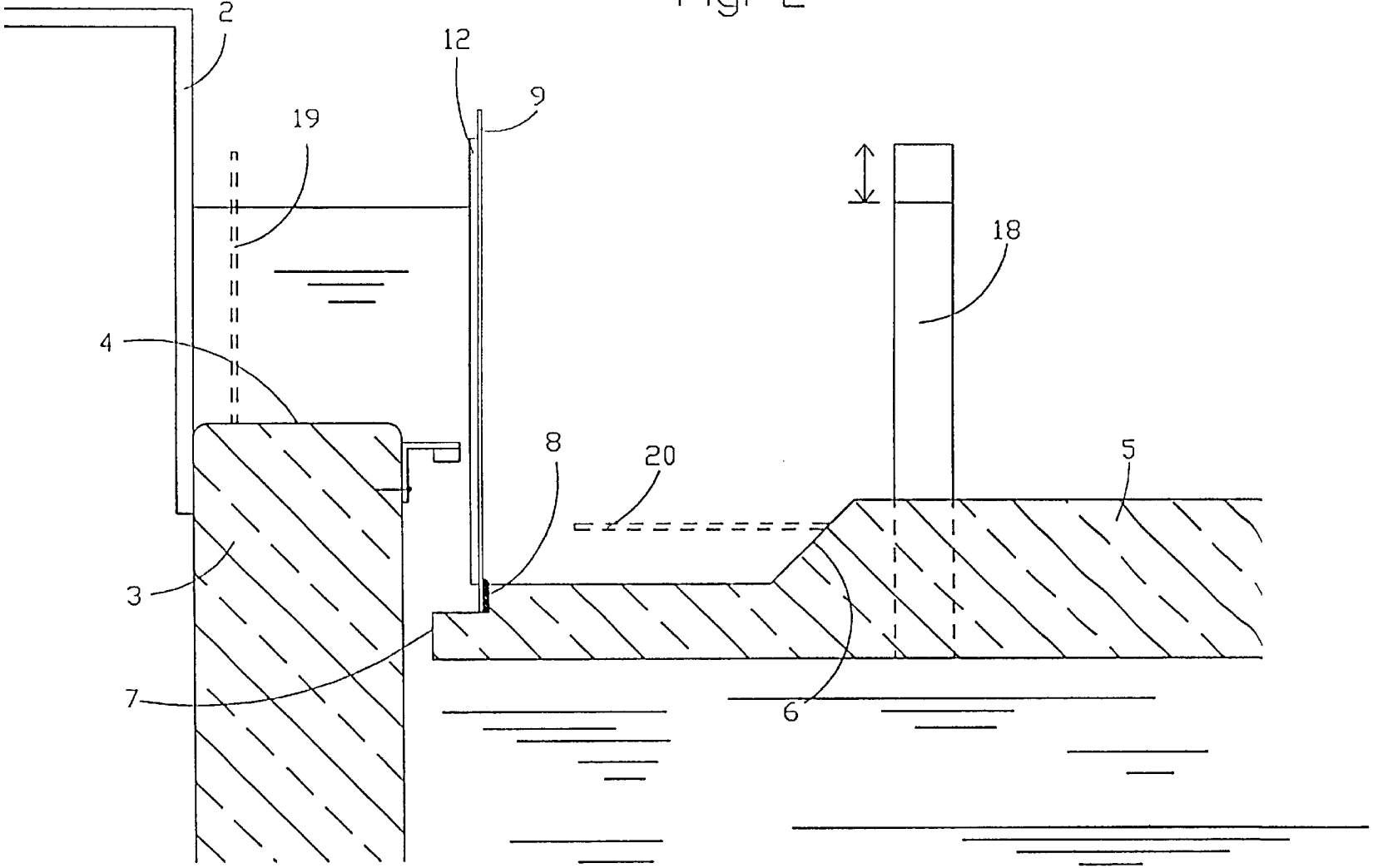
FIG. 2 is a vertical sectional view, on a larger scale, of an upper portion of the structure with the ceiling plate still floating underneath the ceiling height.

The same components or the components having at least the same function are provided with the same reference numerals in the drawing.

A circumferentially closed building wall 3 is erected on a prepared floor plate 1 of reinforced concrete by means of a sliding formwork or climbing formwork 2, not shown in detail. In the illustrated embodiment, the building wall 3 is cylindrical.

FIG. 1 shows the building wall which has already been erected and whose upper end is formed by the upper edge 4.

The outer portion of the sliding or climbing formwork 2 used for manufacturing the building wall protrudes above the upper edge 4. The inner formwork has already been disassembled. The outer portion of the sliding or climbing formwork 2 rests tightly against the building wall 3 and constitutes an upper continuation of the building wall 3.

Before or after the building wall 3 is erected, a ceiling plate 5 is manufactured on the floor plate 1, wherein the ceiling plate 5 may be particularly of reinforced concrete. For this purpose, before the concrete is poured into a prepared formwork, a separating foil can be placed on the floor plate 1, or a spray film is applied which separates the two components.

As shown in FIG. 2, the ceiling plate 5 has in its outer area a reduced thickness which is formed by an inclined portion 6 or a step at the upper side of the ceiling plate. This recessed edge portion has the purpose of later receiving the connecting concrete between the ceiling plate and the building wall.

Figure 3:
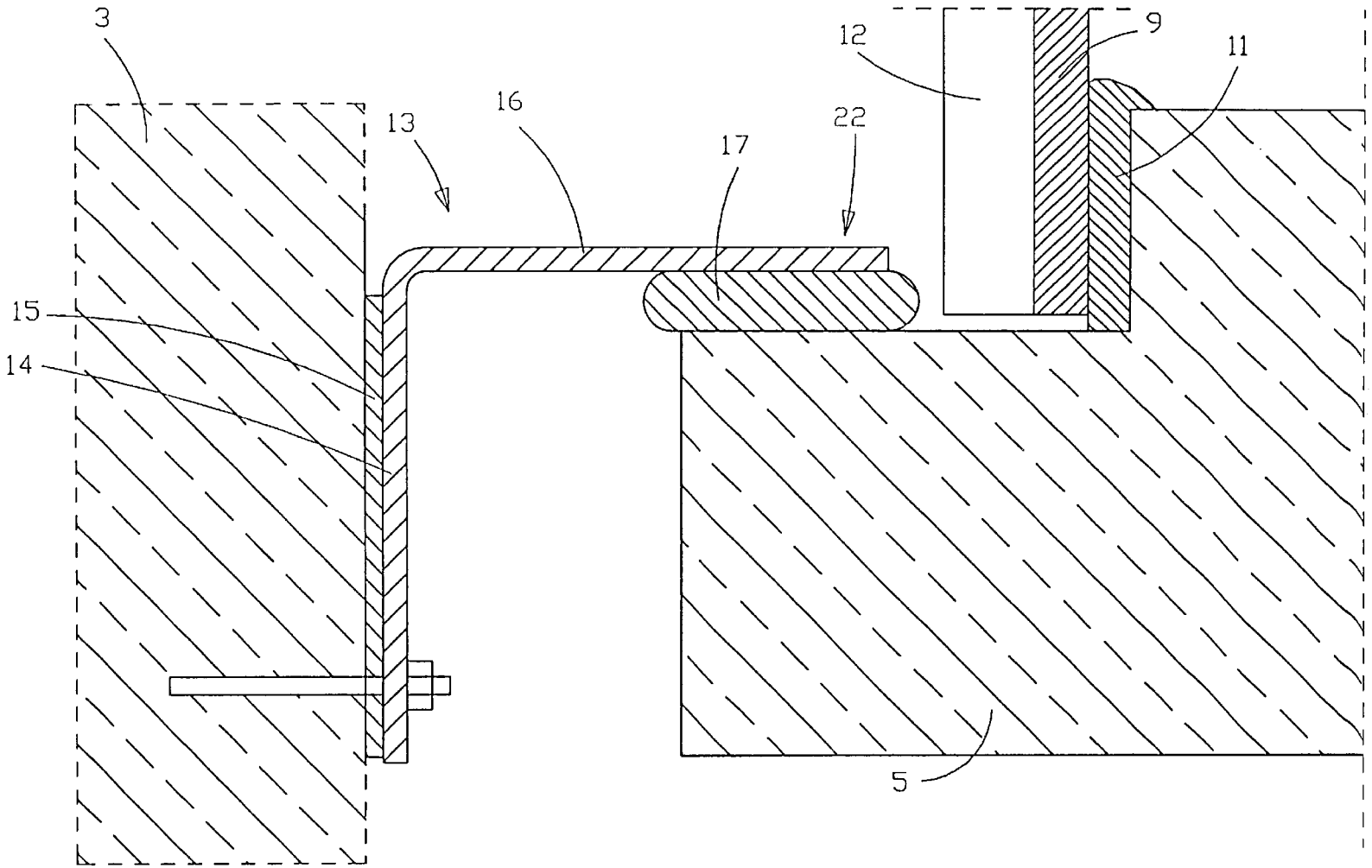
FIG. 3 is a sectional view, on a larger scale as compared to FIG. 2, showing the method step in which the ceiling plate has reached the ceiling height.

In the embodiment illustrated in FIGS. 2 and 3, another step forming a vertical surface 8 is formed outside of the inclined surface 6 in the vicinity of the end surface 7.

A side wall 9 which transforms the ceiling plate into a floating body is now mounted on the ceiling plate 5 which rests on the floor plate 1. The side wall 9 surrounds at its lower end the vertical surface 8 of the ceiling plate and rests on the stepped portion at the rim. The side wall is sealed by foaming the gap between the side wall and the vertical surface with a sealing material 11 or with an elastic cement or by placing a section of soft rubber into the gap; this makes it possible to carry out the sealing process very quickly and simply and a certain support of the side wall 9 against the ceiling plate 5 is achieved.

Figures 4, 7:
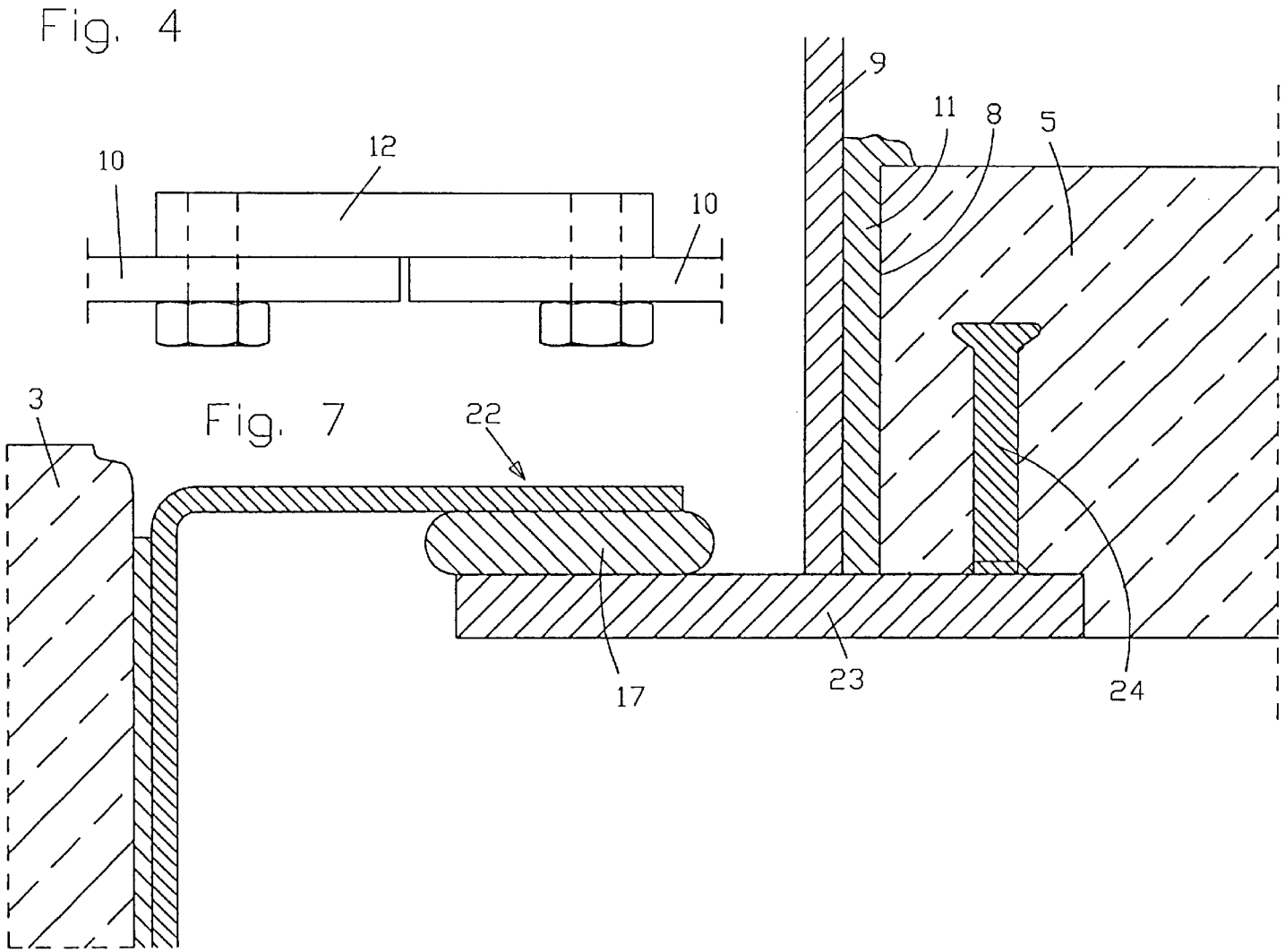
FIG. 4 is a top view showing as a detail the connection between two plates forming the side wall.
FIG. 7 is a sectional view showing yet another embodiment of the ceiling plate.

The side wall 9 is composed of a plurality of sheet piles 10 which are circular arc-shaped in cross-section and are tightly connected to each other. For this purpose, for example, a vertically extending sealing ledge 12 bridging the gap between two sheet piles 10 may be screwed to the two adjacent sheet piles 10, as schematically illustrated in FIG. 4. This facilitates a simple assembly of the side wall 9 even though the side wall 9 is arranged at a close distance from the building wall 3.

For floating the ceiling plate 5, water is pumped into the space defined by the inner side of the building wall, so that the building is gradually filled with water and the floatable ceiling plate 5 is raised by the rising water column and floats on the water column, as seen in FIG. 2. Before the upper end of the side wall 9 reaches the upper edge 4 of the building wall, an angle section 13 is mounted at an accurately leveled position at the building wall, as seen in FIG. 3, so that the leg 14 of the section 13 attached to the inner side of the building wall is sealed relative to the building wall. The vertical position of the angle section 13 can be exactly measured and secured, so that the vertical position of the ceiling to be manufactured is also exactly determined and leveling of the ceiling to be manufactured is possible. The ceiling plate 5 serves as a floating work platform for mounting the angle section 13. Placed between the leg 14 of the angle section 13 to be attached to the building wall 3 and the building wall 3 is a sealing member 15, for example, in the form of a soft rubber section or cellular rubber section for sealing the angle section 13 relative to the building wall 3. A sealing member 17, which may also be formed by a soft rubber part, is secured to the bottom side of the inwardly protruding leg 16 of the angle section 13.

This inwardly protruding leg 16 of the angle section 13 forms together with the sealing member 17 attached to the bottom side of the leg 16 a stop 22 which limits the upward flotation of the ceiling plate when the ceiling plate 5 has reached its upper end position which corresponds to the position of the building ceiling to be manufactured, as seen in FIG. 3. After the ceiling plate makes contact with the sealing member 17, a liquid-tight connection is effected between the ceiling plate 5 and the building wall. The water body underneath the ceiling plate can now be provided with a slight excess pressure. For regulating this excess pressure, a vertical rising pipe 18, shown in FIG. 2, is provided which extends through the ceiling plate 5 or forms a continuation of an opening in the ceiling plate 5. Preferably, the length of the rising pipe 18 is such that, when the desired excess pressure is reached, the water column reaches the upper end of the rising pipe 18 and emerges from the pipe. This reliably prevents an overpressure of the ceiling plate against the stop 22.

The water located above the sealed portion between the ceiling plate 5 and the upper edge 4 of the building wall and between the formwork 2 and the side wall 9 can now be pumped off and the sheet piles of the side wall can be disassembled.

Subsequently, the reinforcing steel members 19 which upwardly protrude from the upper edge 4 of the building wall (only one reinforcing steel member 19 is shown in broken lines in FIG. 2) are bent inwardly and connected to the reinforcing steel members 20 (again, only one steel member 20 is shown in broken lines in FIG. 2) which protrude from the stepped rim portion of the ceiling plate 5. The stepped rim portion is now filled with concrete 21, as seen in FIG. 5. This anchors the building ceiling.

The method according to the invention can be used in an analogous manner if the ceiling plate is to be secured underneath the upper edge 4 of the building wall.

The existing excess pressure and the pressure of the ceiling plate 5 against the stop 22 ensure that the ceiling plate does not sink downwardly when the connecting concrete 21 is placed.

Figure 6:
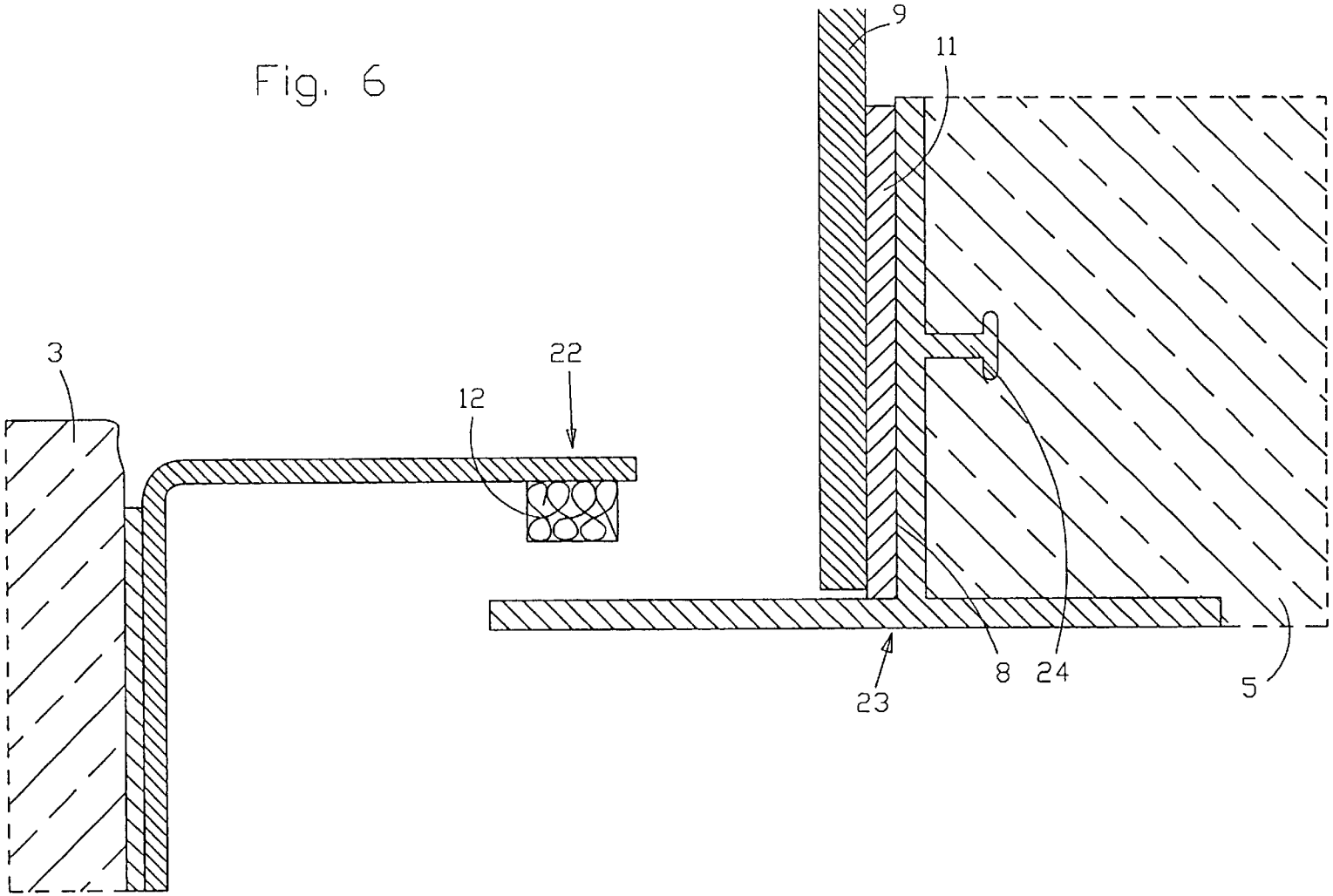
FIG. 6 is a sectional view showing another embodiment of the ceiling plate.

A slightly modified embodiment of the ceiling plate is illustrated in FIG. 6. In this embodiment, a component 23 is mounted at the end face of the ceiling plate or is embedded in the concrete of the ceiling plate through an anchor 24 which is connected by welding or forms an integral part of component 23. The component 23 essentially is a T-section with a horizontal flange and a vertical web. The vertical web simultaneously serves as a formwork for manufacturing the ceiling plate 5, and the horizontal flange rests partly against the bottom side of the concrete at the rim of the ceiling plate and partially protrudes outwardly beyond the outer rim. The side wall 9 is arranged outside of the vertical surface 8 formed by the vertical web of the component 23 and rests on the outwardly protruding horizontal flange of the component 23, wherein, in turn, a sealing material 11 is introduced between the side wall 9 and the vertical web 8. When the ceiling plate floats upwardly, the upwardly protruding horizontal flange of the component 23 makes contact with the stop 22 when the ceiling plate has reached its upper end position.

A similar embodiment of the ceiling plate is also illustrated in FIG. 7. In this case, the component 23 is constructed as a horizontal web to which an anchor 24 protruding into the concrete of the ceiling plate is attached. In this embodiment, the vertical surface 8 is formed by the end face of the concrete at the rim of the ceiling plate.

Although it is preferred to use an angle section 13 for forming the circumferentially extending and circumferentially closed stop, it would, in principle, also be possible to use, for example, an annular flat steel member attached to the upper edge 4 of the building wall, wherein the flat steel member inwardly protrudes beyond the upper edge 4. Instead of providing the sealing member 17 at the leg 16 or on the flat steel member which inwardly protrudes beyond the upper edge 4 of the building wall, it would also be possible to provide the sealing members 17 on the ceiling plate 5 or on the component 23 at an appropriate location which interacts with the stop 22.

A vertical surface 8 around which the side wall 9 is mounted, could also be provided by a section mounted on the upper side of the ceiling plate, wherein the section has an upwardly protruding web, for example, a L-section or T-section. This section, as is the case in components 23, could be composed, for example, of steel or aluminum.

Further modifications are conceivable and possible without departing from the scope of the invention. For example, the building may have a cross-section which differs from the cylindrical. Also, annular ceilings may be manufactured which are provided between a cylindrical outer wall and a cylindrical inner wall. The shape of the ceiling is variable within wide limits. The ceiling plate manufactured on the floor plate may also have cutouts for columns arranged within the building wall for supporting the finished ceiling. For this embodiment, the method according to the present invention can be used in a completely analogous manner. For sealing the column relative to the ceiling plate in the upper end position of floatation of the ceiling plate, it is possible to arrange an inwardly protruding, circumferential stop at the column.

While specific embodiments of the invention have been shown and described in detail to illustrate the inventive principles, it will be understood that the invention may be embodied otherwise without departing from such principles.

I claim:

1. A method of erecting a building ceiling in a building with a floor plate and a circumferentially closed building wall erected on the floor plate, the method comprising manufacturing the ceiling plate on the floor plate, wherein the ceiling plate has a circumferential contour corresponding to an inner contour of the building wall, mounting a circumferentially closed and watertight side wall on the ceiling plate so as to form a floating body, floating the floating body by filling water into a space defined by an inner side of the building wall and the side wall, connecting the ceiling plate to the building wall after the ceiling wall has reached a ceiling height, mounting an inwardly protruding, circumferential stop on the building wall for limiting an upward floatation of the ceiling plate, such that in an upper end position of the upward floatation the ceiling plate is pressed against the stop and the ceiling plate is sealed relative to the stop.

2. The method according to claim 1, further comprising tightly connecting a circumferential part to the ceiling plate, such that in the upper end position of the floatation the circumferential part is pressed against the stop.

3. The method according to claim 1, further comprising mounting a sealing member between the stop and the ceiling plate on at least one of the stop and the ceiling plate.

4. The method according to claim 2, further comprising mounting a sealing member between the stop and the circumferential part on at least one of the stop and the circumferential part.

5. The method according to claim 3, comprising attaching to the inner side of the building wall a leg of an angle section, such that another of the legs of the angle section forms the circumferential stop.

6. The method according to claim 4, comprising attaching to the inner side of the building wall a leg of an angle section, such that another of the legs of the angle section forms the circumferential stop.

7. The method according to claim 5, comprising fastening the sealing member provided between the stop and the ceiling plate at a bottom side of the leg of the angle section forming the stop.

8. The method according to claim 6, comprising fastening the sealing member provided between the stop and the circumferential part at a bottom side of the leg of the angle section forming the stop.

9. The method according to claim 7, comprising providing a sealing member between the building wall and an inner side of the leg of the angle section attached to the building wall.

10. The method according to claim 1, comprising providing a vertical surface on the ceiling plate, wherein a lower portion of the side wall surrounds and is sealed relative to the vertical surface.

11. The method according to claim 2, comprising providing a vertical surface on the circumferential part, wherein a lower portion of the side wall surrounds and is sealed relative to the vertical surface.

12. The method according to claim 10, comprising forming the vertical surface by a step of the ceiling plate.

13. The method according to claim 10, comprising forming the vertical surface by an end face at a rim of the ceiling plate.

14. The method according to claim 11, comprising forming the vertical surface by an end face of a rim of the surrounding part.

15. The method according to claim 14, wherein the circumferential part protrudes outwardly beyond the end face of the ceiling plate, comprising tightly connecting the circumferential part to the ceiling plate.

16. The method according to claim 15, comprising placing the side wall on the circumferential part.

17. The method according to claim 15, comprising providing the circumferential part with an anchor and imbedding the anchor in concrete of the ceiling plate.

18. The method according to claim 15, comprising providing the circumferential part with a vertical web serving as formwork of the ceiling plate.

19. The method according to claim 1, providing a rising pipe communicating with a space underneath the ceiling plate for adjusting the contact pressure of the ceiling plate against the stop.

20. The method according to claim 19, wherein the rising pipe is constructed with such a length that water emerges from an upper end of the rising pipe when a predetermined contact pressure has been reached.

* * * * *